US006050347A

United States Patent [19]

Jenne

[11] Patent Number: 6,050,347

[45] **Date of Patent: *Apr. 18, 2000**

[54] IN HOLE HAMMER

[75] Inventor: Dietmar Jenne, Strengelbach, Switzerland

[73] Assignee: Terra AG fuer Tiefbautechnik, Strengelbach, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/991,832

[22] Filed: Dec. 16, 1997

[30] Foreign Application Priority Data

Dec. 17, 1996 [DE] Germany ..... 196 52 530

[51] Int. Cl.[7] ..... E21B 4/14

[52] U.S. Cl. ..... 173/91; 173/17; 173/78; 173/80; 173/211; 173/212

[58] Field of Search ..... 173/91, 17, 73, 173/78, 80, 138, 211, 212, 90, 132, 59, 162.1, 201, 149; 175/21, 296

[56] References Cited

U.S. PATENT DOCUMENTS

| | | | |
|---|---|---|---|
| 2,810,549 | 10/1957 | Morrison | 173/212 |
| 3,998,280 | 12/1976 | Kisling, III | 173/149 |
| 5,080,179 | 1/1992 | Gien | 173/17 |
| 5,117,922 | 6/1992 | Baron | 173/91 |
| 5,139,096 | 8/1992 | Lister | 173/78 |
| 5,148,878 | 9/1992 | Schmidt et al. | 173/91 |
| 5,226,487 | 7/1993 | Spektor | 173/91 |
| 5,322,134 | 6/1994 | Dahn | 175/21 |
| 5,325,926 | 7/1994 | Lay | 173/17 |
| 5,337,837 | 8/1994 | Wentworth | 173/91 |
| 5,494,116 | 2/1996 | Wentworth | 173/91 |
| 5,505,270 | 4/1996 | Wentworth | 173/91 |
| 5,662,180 | 9/1997 | Coffman et al. | 173/201 |
| 5,695,014 | 12/1997 | Jenne | 173/91 |
| 5,803,182 | 9/1998 | Bakke | 173/91 |

*Primary Examiner*—Peter Vo
*Assistant Examiner*—Jim Calve
*Attorney, Agent, or Firm*—McCormick, Paulding & Huber LLP

[57] ABSTRACT

An in-hole hammer for boring in ground has an elongated hollow housing carrying an internal striking piston in a piston chamber. An exchangeable boring head is threadably connected to the forward end of the housing and the striking piston impacts against the forward wall of the housing defining the piston chamber to transmit forward driving impact energy to the boring head. A boring rod which urges the hammer forwardly and rotates it about the longitudinal axis is connected to the rear end of the housing through a connecting piece non-rotatably fixed, but slidable relative, to the housing so that the axially directed impact energy produced by the striking piston is not transmitted to the boring rod.

5 Claims, 6 Drawing Sheets

IN HOLE HAMMER

FIELD OF THE INVENTION

The invention concerns an in hole hammer, including a generally cylindrical housing, a back and forth movable pressure medium actuatable striking piston in a piston chamber of the housing, an exchangeably arranged workhead to which the striking energy of the striking piston is transmitted, and a connecting piece non-rotatably connected with the housing for non-rotatable connection of the hammer with a boring rod and for connection with a pressure medium conductor.

BACKGROUND OF THE INVENTION

In hole hammers are generally used for boring in gravelly and stony grounds, especially for operation in stone. In such use the hammer is held in compression from behind by the boring rod and is continually rotated.

The pressure medium, generally pressurized air, enters from behind into the hammer and moves the striking piston in the interior of the hammer. The striking piston impacts onto the workhead, for example a boring crown which is not rigidly connected with the housing but which is guided by a splined shaft rotatably fixed but lengthwise shiftable in the housing. This spline must be relatively long so that high rotation moments can be stably transmitted along with simultaneous dynamic blows. Correspondingly, customary in hole hammers are relatively long, as the longitudinal shiftability between the housing and the boring crown must be assured. The boring crown itself is, because of its length, relatively heavy and expensive. Since the boring crown is a wear part and frequently has to be exchanged, this leads to relatively high operating costs for the drive of the in hole hammer.

The invention has as its basic object the provision of a relatively short compact in hole hammer by means of which the costs for the workhead can be reduced.

SUMMARY OF THE INVENTION

The above object is solved in accordance with the invention in that the workhead is fastened removably but rigidly on the far forward end of the housing and that the impact surface for the striking piston is a forward wall of the piston chamber arranged generally normal to the axis of the hammer.

The inventive solution allows the workhead to be made short and relatively light. Since the previously necessary shaft to the boring crown is eliminated, the boring crown becomes not only reasonable in price but it also shortens the entire length of the hammer to at least a portion of the length of the previously necessary shaft, as the striking piston now does not strike onto the rear shaft end but onto the forward wall of the piston chamber. A shorter in hole hammer is especially of advantage when work is to be done from narrow pressed holes or indeed from existing sewer pipes, which customarily have a diameter of from 1200 to 1600 mm, in order, for example to lay a house connection perpendicularly from a sewer pipe.

To simplify the exchange of the workhead, the workhead is preferably screwed onto a threaded forward extension of the housing. In order to be able to again loosen this threaded connection, which by the combined hammering and rotational movement during the operation of the hammer, can become extraordinarily tightened, it is practical to arrange between the workhead and the housing a separating ring.

This ring when the threaded connection to be loosened is destroyed by grinding, so that subsequently the workhead can be again unscrewed from the threaded forward extension.

Practically, at least one outflow channel for leading the pressure medium from the piston chamber is formed in the forward end of the housing and in the workhead. The outflowing pressure medium serves during boring to deliver the boring gravel (pulverized stone) rearwardly through the gaps in the boring crown. In connection with this, the exit opening of at least one of the outflow channels is provided on the forward side of the workhead facing in the advancement direction of the hammer. In mixed grounds, which for example contain loam components, there exists danger that these openings can become plugged. To avoid this, it is proposed that at least one outflow channel have its exit opening in a side or rear surface of the workhead.

The workhead can either, as previously mentioned, be a boring crown provided with hard metal elements or also can be a ram head which serves to ram in pipes and which has a conical sleeve surface for coupling with a pipe or with ram rings which are insertable into larger diameter pipes.

For straight boring, the boring crown customarily is provided with an axis normal forward surface on which the hard metal elements are arranged. In order to be able to control the advancement direction of the in hole hammer at least slightly, the boring head can be provided with a control surface which intersects the axis normal forward surface by an angle of less than 90° and which like the forward surface is provided with hard metal elements.

The striking mechanism of the in hole hammer is preferably so formed, that the striking piston has a first rearwardly opening bore receiving a first control tube connected rigidly to the housing and arranged coaxially to the housing inside of the piston chamber at a radial spacing from the inner wall of the housing and which has an axial pressure medium channel, that the striking piston further has a second bore opening forwardly in which a second control tube is received, which second control tube is rigidly connected with the housing and is arranged coaxially to the housing inside of the piston chamber at a radial spacing from the inner wall of the housing and has an axial pressure medium channel, and that in each of the wall sections surrounding the first and second striking piston bores at least one control opening is formed, which in cooperation with the free end of the associated control tube controls the pressure medium flow to or the pressure fluid flow from the space between the forward end of the striking piston and the impact surface.

According to a preferred embodiment of the invention, a closed gas filled annular space is provided between the first control tube and the inner wall of the piston chamber, in which space the striking piston is guided by the wall section surrounding the first control tube. The gas contained in the annular space, usually air, is compressed by the rearward movement of the striking piston and thereby damps that rearward movement. At the same time, the annular space serves as a pressure store, insofar as the gas compressed during the rearward travel of the piston assists the following forward movement of the piston. This leads to a distinct increase in the striking energy and to a satisfactory impact of the striking piston onto the forward impact surface.

As in the in hole hammer of the invention, the striking energy is transmitted to the entire hammer housing, it would also be transmitted to the boring rod in case of a rigid connection of the housing with the boring rod. Therefore, the danger of breaking the rod would exist. To avoid this, in the solution of the invention the connecting piece has a coupling section connectable to the boring rod and to the pressure medium conductor and also a guide section, with which guide section the connecting piece is guided in the housing for axial sliding between two end positions. In the housing an annular space surrounding the guide section along a portion of its length is formed, with that space in the axial direction on one side being closed by a seal ring fixed to the housing end on the other side being closed by a seal ring fixed to the guide section and with that space standing in connection with a pressure fluid channel extending through the connecting piece by a radial bore in the guide section. Thereby the hammer housing can move axially through a given range relative to the connecting piece and therewith also to the boring rod connected to the connecting piece. The axial movement is thereby damped by the air pressure enclosed between the seal rings. Further, the pressurized air entering the annular space between the two seal rings through the radial bore has the effect that the housing becomes set to its rear end position insofar as the air pressure presses the two seal rings away from one another.

Further features and advantages of the invention will be apparent from the following description which in connection with the accompanying drawings explain the invention by way of exemplary embodiments.

DESCRIPTION OF THE PREFERRED EMBODIMENTS

Figure 1:
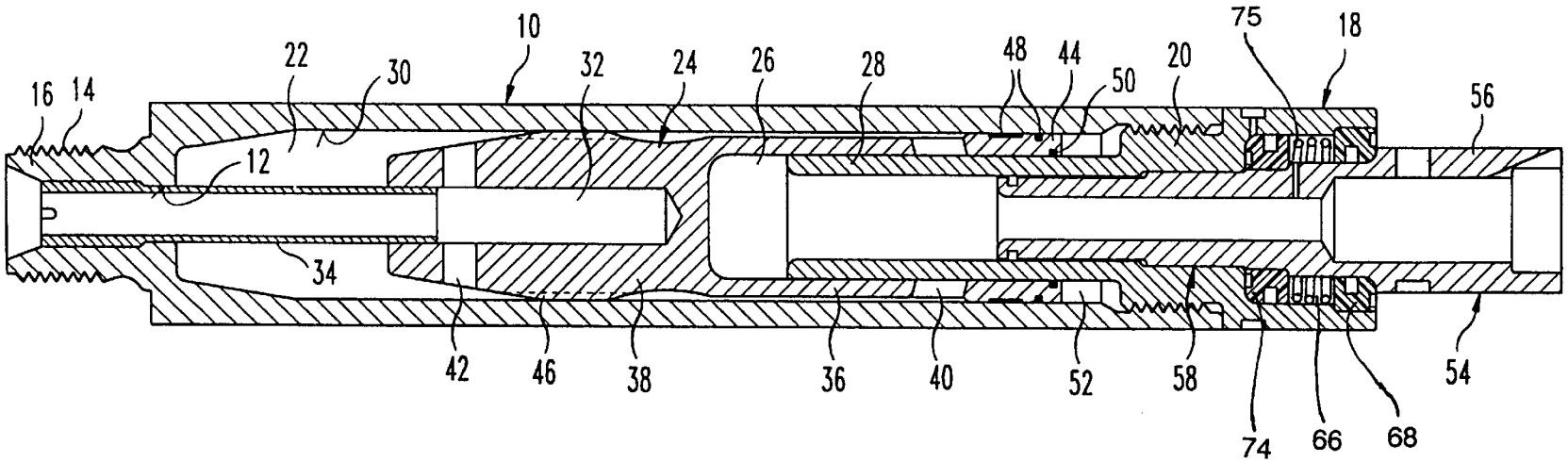
FIG. 1—a partially schematic sectional view taken through and containing the axis of an in hole hammer embodying the invention and showing with its striking piston in its rearward position.
Figure 2:
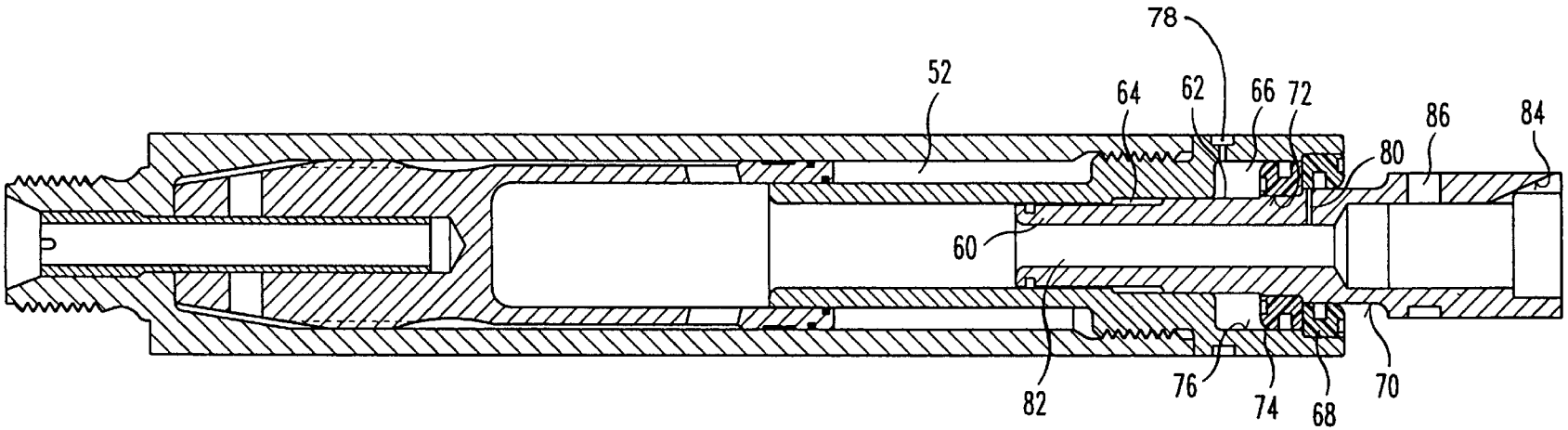
FIG. 2—an illustration corresponding to FIG. 1 and showing the striking piston in its forward position.

The in hole hammer illustrated in FIGS. 1 and 2 has a longitudinal axis 11 and includes a cylindrical tube-shaped housing 10 which at its forward, or left-hand end in FIGS. 1 and 2, is closed up to an axial bore 12 and finishes with an extension 16 having an external thread 14. At its rearward or right-hand end in FIGS. 1 and 2, the tube-shaped housing 10 is closed by a base portion 18 which with a threaded part 20 is threaded into the rearward end of the housing 10 provided with an internal thread.

The housing 10 surrounds a piston chamber 22 in which a striking piston, indicated generally at 24, is slidably guided.

The striking piston 24 has a first rearwardly opening bore 26 into which extends a control tube 28 of one piece with the base portion 18 and which extends coaxially to the housing 10 in the piston chamber 22 at a radial spacing from the inner wall 30 of the housing. The base portion and the control tube can obviously also be made as separate parts. The striking piston further has a second bore 32 opening axially from its forward end, in which bore 32 a forward control tube 34 is received. The control tube 34 is fitted in the bore 12 of the housing 10 and extends with a radial spacing from the inner wall 30 of the housing 10 coaxially to the housing 10 into the piston chamber 22. In the piston wall sections 36 and 38 surrounding the bores 26 and 32 are formed control openings 40 and 42 which connect the associated bore internal spaces with the space outside of the striking piston 24, that is, with the piston chamber 22.

The outer diameter of the striking piston corresponds to the inner diameter of the housing 10 only in a rearward end region 44 and in a head region 46 of the striking piston, so that the striking piston slides on the inner wall 30 only in these regions 44 and 46. In the remaining regions, the outer diameter of the striking piston 24 is somewhat smaller than the inner diameter of the housing 10. In the wall surfaces of the rearward section 44 of the striking piston 24 which slides on the inner wall 30 and on the outer wall of the control tube 28, seals 48 and 50 are placed which hermetically seal the annular space 52 between the inner wall 30 and the control tube 28 on the side of the striking piston 24, the control tube 28 at its right end being closed by the part 20 of the base portion 18. This annular space 52, therefore, has no connection to the outside.

The connection of the so far described in hole hammer with a non-illustrated boring rod takes place through a connecting piece indicated generally at 54. This connecting piece consists of a coupling section 56 and a guide section 58 which is inserted in the base part 18 coaxially to the housing 10. A cylindrical end section 60 of the guide section 58 extends into the inner bore of the control tube 28. From this end section 60 to the coupling section 56 is a section 62 having its outer surface formed as a hexagon which in turn is received in a complementary recess 64 of hexagonal cross section formed in the part 20 of the base part 18, so that the connecting piece 54 is rotationally fixed to the base part 18 and thereby also to the housing 10.

An annular chamber surrounding the guide section 58 of the connecting piece 54 is formed to the right of the part 20 connected to the end section of the base part 18, which annular chamber 66, outside in is closed by a seal ring 68 rigidly connected with the base part 18, which sealing ring 68 can slide on a cylindrical annular surface 70 of the connecting piece 54. A further seal ring 74 sits on the hexagonal section 62 of the connecting annular surface 72 of the guide section 58, the further sealing ring 74 being connected with the connecting piece 54 and being slidable on the inner surface 76 of the section of the base part defining the annular space 66. The annular space 66 stands, by means of a bore 78 formed radially in the base part 18, in connection with the surrounding air and by means of a radial bore 80 formed in the guide section 58 of the connecting piece 54 in connection with a channel 82 which passes through the entire connecting piece 54 in the axial direction.

The part of the channel 82 running through the coupling section 56 has a polygonal cross-section and serves to receive a complementary pin on the boring rod to connect the hammer in rotatably fixed condition to the boring rod. A ramp surface 84 on the input end of the coupling section 56 serves to press a spring bolt on the coupling pin of the boring rod radially inwardly until the coupling pin has been pushed so far into the coupling section 56 that the bolt can latch into a radial bore 86 in the coupling section 56, so that the coupling pin can no longer remove itself from its reception by the coupling section 56 by sliding outwardly.

The striking mechanism of the so far described in hole hammer works in the following way:

By a non-illustrated hollow boring rod inserted into the coupling section 56 pressurized air is delivered through the channel 82 of the connecting piece 54 and the inner bore of the control tube 28 to the bore 26 of the striking piston, which can be considered to be first in the rearward position illustrated in FIG. 1. Since the air cannot escape from the space 26, the striking piston 24 of FIG. 1 is driven toward the left, that is forwardly, until reaching the position illustrated in FIG. 2, in which the piston impacts onto the forward surface 87 of the piston chamber 22. The striking energy of the striking piston 24 is thereby transmitted to the housing 10 and to the base portion 18 connected with the housing. Shortly before reaching the end position illustrated in FIG. 2, the control openings 40 in the wall section 36 of the striking piston 24 pass over the left free edge of the control tube 28 so that the pressurized air can escape radially outwardly from the control tube 28 and from the space 26 through the control openings 40. The pressurized air cannot escape rearwardly since the seals 48 and 50 close the annular gap between the striking piston outer wall and the inner wall 30 of the housing 10. The pressurized air, however, moves forwardly through the annular gap seen in FIGS. 1 and 2, with the air being able to flow through grooves parallel to the axis of the hammer, indicated by broken lines and located on the outer surface of the head portion 46 of the striking piston. The air arrives in the forward portion of the piston chamber 22 and now drives the striking piston 24 from the position illustrated in FIG. 2 in the direction toward the position illustrated in FIG. 1 because of the differences in the piston surfaces exposed to the pressure. When the control openings 42 in the wall section 38 of the piston 24 pass over the right free end of the control tube 34, a connection between the piston chamber 22 and the control tube 34 through to the outside world is created by means of the openings 42. In the meantime, the control openings 40 in the wall section 36 of the striking piston have again passed over the free edge of the control tube 28 so that the space 26 in the striking piston 24 is again closed. The pressure fluid flowing into this space 26 drives the striking piston 24 again toward the left, so that the procedure is repeated.

This movement of the striking piston toward the left is supported by the pressure of the air which is found in the hermetically closed annular space 52 and which during the movement of the striking piston 24 toward the right is compressed. The air filling of the annular space 52, therefore, is effectively an elastic air cushion which damps the rearward movement of the striking piston 24 toward the right and which at the same time acts as a pressure store which again drives the striking piston 24 toward the left.

Upon impact of the striking piston 24 onto the surface 87 of the housing 10, the housing 10 is moved forwardly relative to the boring rod and to the connecting piece 54 connected axially immovably to the connecting rod, that is towards the left in FIG. 2. If these movements were to be transmitted directly to the boring rod, the boring rod would be quickly destroyed. For this reason, between the hammer and the boring rod, a length compensating and damping apparatus is so made that the connecting piece 54 is movable relative to the housing 10 and base part 18. In the illustrated embodiment, the length compensating and dampening apparatus works pneumatically. In the position of the in hole hammer according to FIG. 1 pressurized air flows through the channel 80 into the portion of the annular space 66 lying between the sealing rings 68 and 74.

When the sealing rings 68 and 74 move toward one another, the enclosed air located between them is pressed through the radial bore 80 and thereby the relative movement of the hammer housing 10 relative to the connecting piece 54 is damped. Between the hollow space formed at the rear side of the sealing ring 74 and the surrounding air, an air exchange takes place through the bore 78. Consequently, the air pressure drives the rings 68 and 74 again away from one another. With technically correct use, that is when the boring rod is constantly is held under soft tension, the sealing rings 68 and 74 do not contact one another during the use of the in hole hammer. If desired, a helical compression spring 75 may be arranged between the rings 68 and 74, as shown in FIG. 1, to elastically bias the connecting piece 54 toward the end position shown in FIG. 1.

In place of the pneumatic length compensation, a mechanical solution can also be provided, in that between the two sealing rings 68 and 64, a helical compression spring is arranged.

Figure 4:
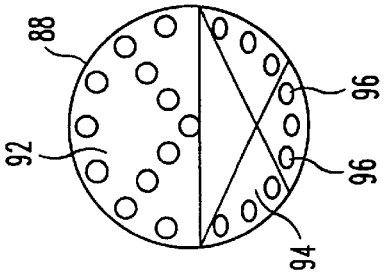
FIG. 4—a front view of the boring crown illustrated in FIG. 3.
Figure 3:
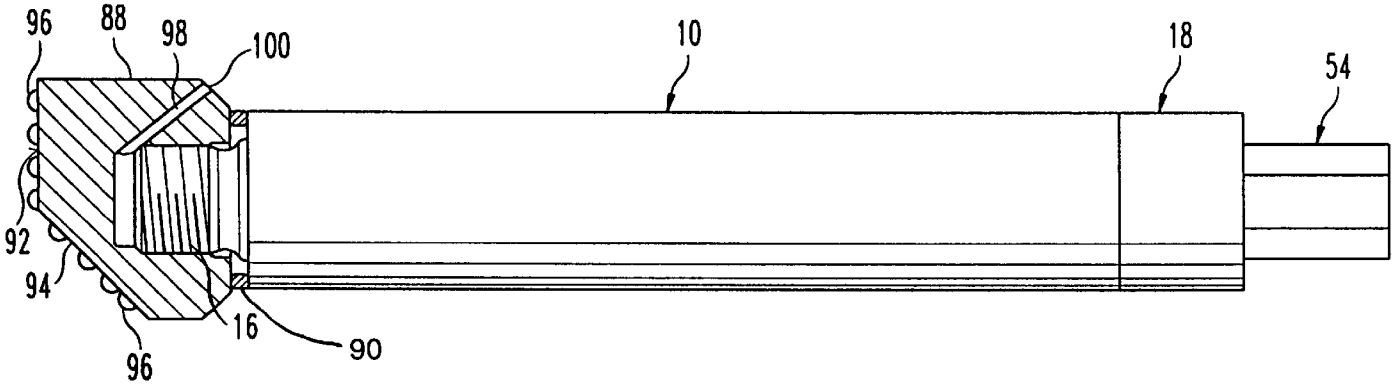
FIG. 3—a side view of an in hole hammer embodying the invention with a boring crown illustrated in section according to a first embodiment of the boring crown.

FIGS. 3 and 4 show a first embodiment of a boring head or a boring crown, 88 which is threaded onto the threaded extension 16. As can be seen in FIG. 3, in the threading on of the crown a separating ring 90 is compressed between the boring crown 88 and the housing 10. Upon operation of the in hole hammer, the threaded connection between the boring crown and the housing 10 is so tightened that one can no longer loosen the boring crown from the housing. Before the threading off of the boring crown, the separating ring 90 is destroyed, for example, ground off, and then the boring crown 88 can be threaded from the threaded part 16 without difficulty.

In the embodiment illustrated in FIG. 3, the boring crown has a forward surface 92 normal to the axis 11 of the hammer and a control surface 94 intersecting the forward surface 92, with both of the surfaces being provided with hard metal elements 96. So long as the in hole hammer is rotated, the control surface 94 has no influence on the boring direction. If the in hole hammer on the contrary is no longer rotated, the control surface 94 effects a deflection, so that the direction of the in hole hammer and therewith the direction of the bore can be changed as desired with the help of the control surface 94.

In the embodiment illustrated in FIG. 3, the boring crown 88 is seen to have an exhaust air channel 98 directed inclinedly rearwardly, through which the exhaust air escaping from the forward control tube 34 can reach the free atmosphere. The exit opening 100 of the exhaust air channel 98 in this embodiment lies on the rear side of the boring crown 88, so that it in operation cannot be plugged by bore gravel or ground.

Figure 6:
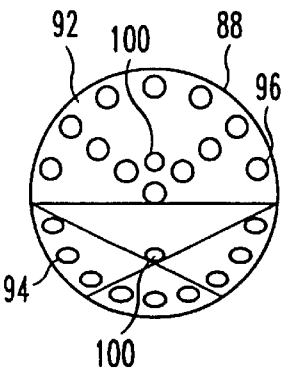
FIG. 6—a front view of the boring crown of FIG. 5.
Figure 5:
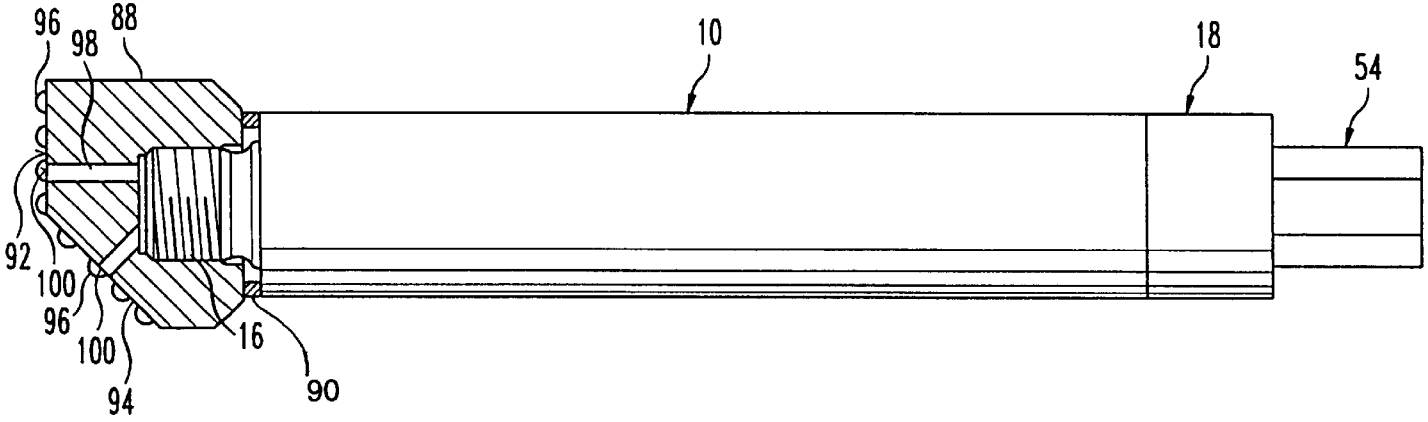
FIG. 5—an illustration corresponding to FIG. 3 showing a second embodiment of the boring crown.

In the embodiment illustrated in FIGS. 5 and 6, the exhaust air channels are directed toward the forward surface 92 and the control surface 94 and are, therefore, open toward the forward drive direction. This solution has the advantage that the escaping air blows away the boring gravel and conveys it rearwardly. This embodiment, however, is not suited for mixed earth, which depending on circumstances also contain loam components, since these components can plug up the exhaust air channels 98.

Figure 7:
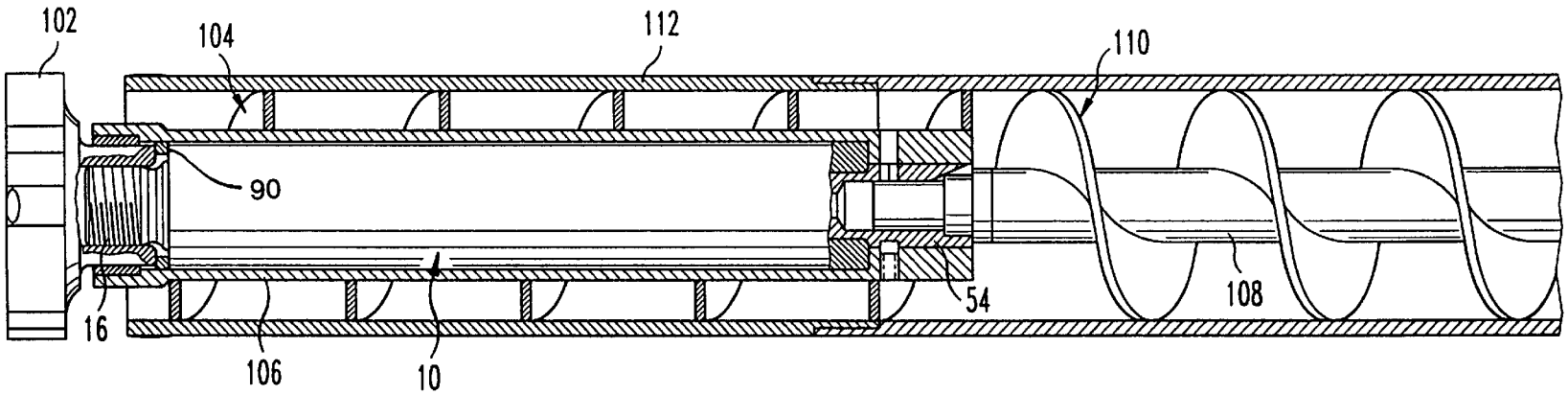
FIG. 7—a schematic partially sectional illustration of an in hole hammer according to the invention in use in a sheathed bore hole.

FIG. 7 shows an in hole hammer with a boring crown 102 which in contrast to the embodiment illustrated in FIGS. 3 and 5 has only an axis normal forward surface and no control surface. The hammer itself is located in the middle tube of a conveying screw indicated generally at 104 and is coupled with a boring rod 108 which on its side likewise is surrounded by a helical flight and together with this forms a conveying screw 110, which like the conveying screw 104 lies on the inner wall of a sheath 112 which lines the bore being worked. The conveying screws 104 and 110 serve to convey the boring gravel rearwardly.

Figure 8:
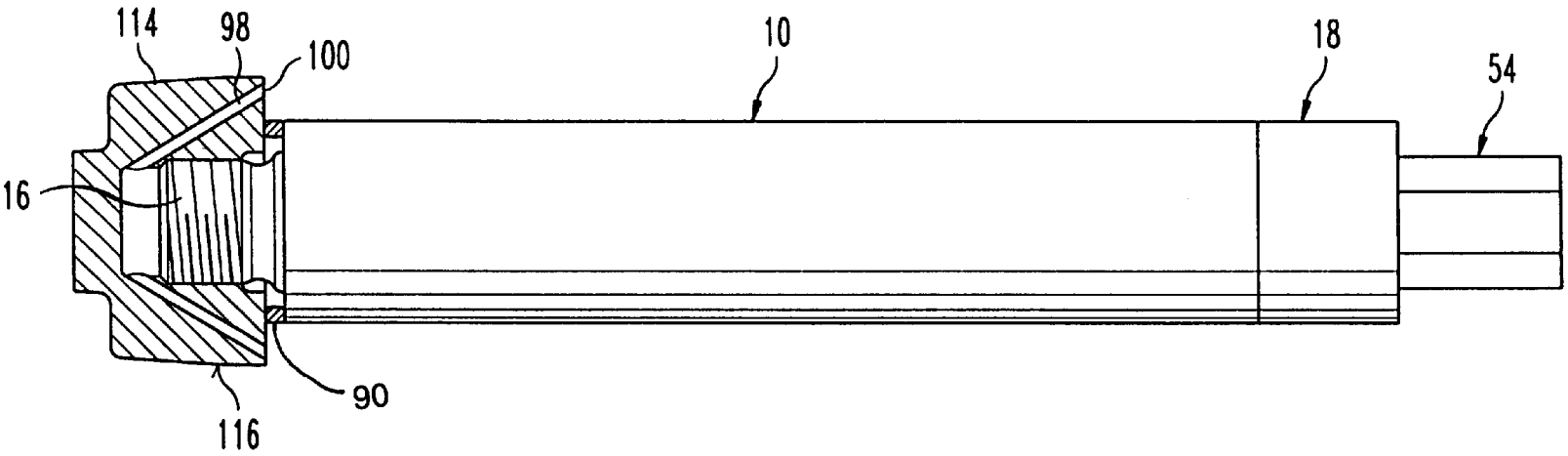
FIG. 8—an illustration corresponding to the views of FIGS. 3 and 5 and showing an in hole hammer according to the invention with a ram head illustrated in section.

FIG. 8 finally shows an in hole hammer according to the invention such as described in connection with FIGS. 1 and 2, which is not equipped with a boring crown but instead is equipped with a ram head 114. This ram head has a conical sleeve surface 116 which can be stuck into a pipe to be rammed in or into a ram ring which in turn can be inserted into a pipe of suitable diameter.

I claim:

1. An in-hole hammer having a longitudinal axis (11) and for use with a work head and a boring rod both removably connectable with the hammer, said in-hole hammer comprising:

a generally cylindrical hammer housing (10, 18) extending along said longitudinal axis and having forward and rear ends, said forward end of said housing being adapted to removably receive a work head (88, 102, 114) and to fixedly connect such work head to the housing, said forward end of said hammer housing forming a forward wall and striking surface of a piston chamber (22), a control tube (28) disposed forward of the rear end of the housing for supplying a pressure medium to said piston chamber (22), a back and forth movable pressure medium actuatable striking piston (24) in the piston chamber (22) of the housing (10, 18), a connecting piece (54) non-rotatably connected with the rear end of the housing (10, 18) for non-rotatable and removable connection of the in-hole hammer with a boring rod (108), said connecting piece (54) having a forward end section (60) slidably disposed within the control tube and a coupling section (56) connectable with a boring rod (108), and a length compensating mechanism which makes possible and damps relative movement between said housing and said connecting piece (54) along said longitudinal axis, said length compensating mechanism including a guide section (58) on said connecting piece (54) which guide section is formed between the forward end section (60) and the coupling section (56) and supported and guided by the housing (10, 18) for slidable motion of the connecting piece along said longitudinal axis between first and second end positions relative to said housing, the connecting piece in said first end position being positioned further into said housing than in said second end position, and biasing means disposed within an annular space (66) between said housing and said connecting piece for biasing said connecting piece (54) towards said first end position relative to said housing.

2. An in-hole hammer according to claim 1, wherein:

the hammer housing defines the annular space (66) which surrounds the guide section (58) and which annular space (66) in the direction of said longitudinal axis is bounded by a first ring (68) fixedly connected with the housing (10, 18) and by a second ring (74) fixedly connected with the guide section, and said biasing means is a helical compression spring (75) located in said annular space (66) and arranged between said first and second rings (68, 74).

3. An in-hole hammer as defined in claim 1, wherein:

the hammer housing defines the annular space (66) surrounding the guide section (58) and which annular space (66) in the direction of said longitudinal axis is closed by a first sealing ring (68) fixedly connected to the housing (10, 18) and by a second sealing ring (74) fixedly connected with the guide section (58), and said annular space (66) stands in connection with a pressure medium channel (82) passing through the connecting piece (54) by means of a radial bore (80) in the guide section (58) so that pressure medium entering said annular space (66) through bore (80) acts as said biasing means.

4. An in-hole hammer according to claim 1, wherein:

the connecting piece (54) is adapted for connection with a boring rod (108), which boring rod has a tubular bore for conducting pressure medium to the in-hole hammer, said connecting piece (54) having a pressure medium channel (82) for conducting pressure medium from the tubular bore of the boring rod to the piston (24).

5. An in-hole hammer as defined in claim 4, wherein:

said connecting piece (54) is aligned with said longitudinal axis (11) of the in-hole hammer.

* * * * *